US005719463A

United States Patent [19]

Hassink et al.

[11] Patent Number: 5,719,463

[45] Date of Patent: Feb. 17, 1998

[54] RETAINING SPRING AND STOP MEANS FOR LAMP MOUNT

[75] Inventors: Martin N. Hassink, Macedonia; Gerald E. Duffy, University Heights, both of Ohio

[73] Assignee: General Electric Company, Schenectady, N.Y.

[21] Appl. No.: 656,749

[22] Filed: Jun. 3, 1996

[51] Int. Cl.[6] ..... H01J 61/34

[52] U.S. Cl. ..... 313/25; 313/269

[58] Field of Search ..... 313/25, 269

[56] References Cited

U.S. PATENT DOCUMENTS 4,161,672 7/1979 Cap et al. .

4,401,913 8/1983 Koza et al. ..... 313/25

4,499,396 2/1985 Fohl et al. ..... 323/25

5,065,069 11/1991 Hunter ..... 313/25

5,075,588 12/1991 Hunter ..... 313/25

5,493,167 2/1996 Mikol et al. .

*Primary Examiner*—Nimeshkumar Patel

*Attorney, Agent, or Firm*—George E. Hawranko

[57] ABSTRACT

A metal halide arc discharge lamp includes a sealed outer envelope, an arc tube located within the envelope, a cylindrical shroud positioned around the arc tube, stops positioned at ends of the shroud to capture the shroud therebetween, conduction wires which both provide electrical energy to the arc tube and mechanically support the arc tube and the shroud, and a compression spring secured by an eyelet for removing tension loading from the arc tube.

14 Claims, 2 Drawing Sheets

RETAINING SPRING AND STOP MEANS FOR LAMP MOUNT

FIELD OF THE INVENTION

This invention pertains to the art of electric lamp assemblies such as discharge lamps, and more particularly to an improved structure for supporting a shroud on a high pressure discharge lamps with arc tubes. The invention is specifically applicable to various lamps including low wattage open fixture lamps employing a shroud surrounding an arc tube, and will be described with reference thereto. However, it will be appreciated that the invention has broader applications and may be advantageously employed in environments and applications related to the preferred embodiments described below.

BACKGROUND OF THE INVENTION

Metal halide arc discharge lamps are frequently employed in commercial usage because of their high luminous efficacy and long life.

In general, a typical metal halide arc discharge lamp includes a quartz or fused silica lamp capsule or arc tube that is hermetically sealed within a borosilicate glass bulb or outer envelope. The arc tube, itself hermetically sealed, has tungsten electrodes press sealed in opposite ends and has a bulb portion containing fill material including mercury, metal halide additives, and a rare gas to facilitate starting. In some cases, both in low and high wattage lamps, the outer envelope is filled with nitrogen or another inert gas at less than atmospheric pressure. In other cases, particularly in low wattage lamps, the outer envelope is evacuated.

It has been found desirable to provide metal halide arc discharge lamps with a shroud which comprises a generally cylindrical shaped light-transmissive material, such as quartz, that is able to withstand high operating temperatures. The arc tube is located within the shroud, that is, the shroud encapsulates the arc tube, and the arc tube and the shroud are coaxially mounted within the lamp outer envelope.

The shroud improves the safety of the lamp by encapsulating the arc tube and thus acting as a containment device in the event that the arc tube shatters. Specifically, the purpose for the shroud and its position encapsulating the arc tube is to absorb the energy created during the rupture of the arc tube. The result is that the shroud allows the lamp outer envelope to remain intact by dissipating the energy of a shattering arc tube.

However, the current shroud designs such as that disclosed in U.S. Pat. No. 5,493,167, use the arc tube itself as a tension member in conjunction with the insulator supports and glass tube or shroud as compression members. The result is loose contact between the tension and compression members as well as parts slipping in relation to each other. In addition, vibrations of the lamp cause audible collisions between the compression members and large shocks to the lamp are transmitted through these members to the support structure.

In addition, these tension and compression members are typically made of inelastic materials which are not robust to such shocks and vibration resulting in failure thereof. Also, the use of the arc tube as a tension member presents significant stress and strain on the sensitive arc tube seal structures.

SUMMARY OF THE INVENTION

The present invention provides an improved electric lamp assembly which solves the above noted problems found in prior art lamps. The lamp assembly was designed to be used in metal halide lamps of the open-type (absence of an expensive cover plate, that is, wherein additional fixture containment shielding is not present), although the lamp assembly may be used in a closed type also. In accordance with the present invention, the improved lamp assembly has an outer envelope, a glass stem, a base, a shroud or glass tube, a pair of stops, a lamp capsule or arc tube, a pair of conductor wires, and tension shifting means. The outer envelope has a dome portion and a neck portion. The glass stem hermetically seals the envelope. The glass stem has first and second stem leads therein. The base is capable of connection to an electrical source and is affixed to the neck region of the outer envelope. The shroud has an interior chamber. The arc tube is located within the interior chamber of the shroud and is supported by the support stops. The arc tube has electrode leads therein. The pair of conductor wires electrically couple the stem leads to the electrode leads, and supply additional mechanical support for the lamp. The tension shifting means remove tension loading from the arc tube. Alternatively or supplementally, the tension shifting means absorb vibration, and maintain close contact amongst the inelastic members of the lamp. The tension shifting means may be embodied as a compression spring secured to the first conductor wire. A stop means secures the compression spring to the first conductor wire, where the stop means is an eyelet.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, preferred embodiments of which will be described in detail in this specification and illustrated in the accompanying drawings which form a part hereof, and wherein.

DETAILED DESCRIPTION OF THE PREFERRED EMBODIMENTS

Figure 1:
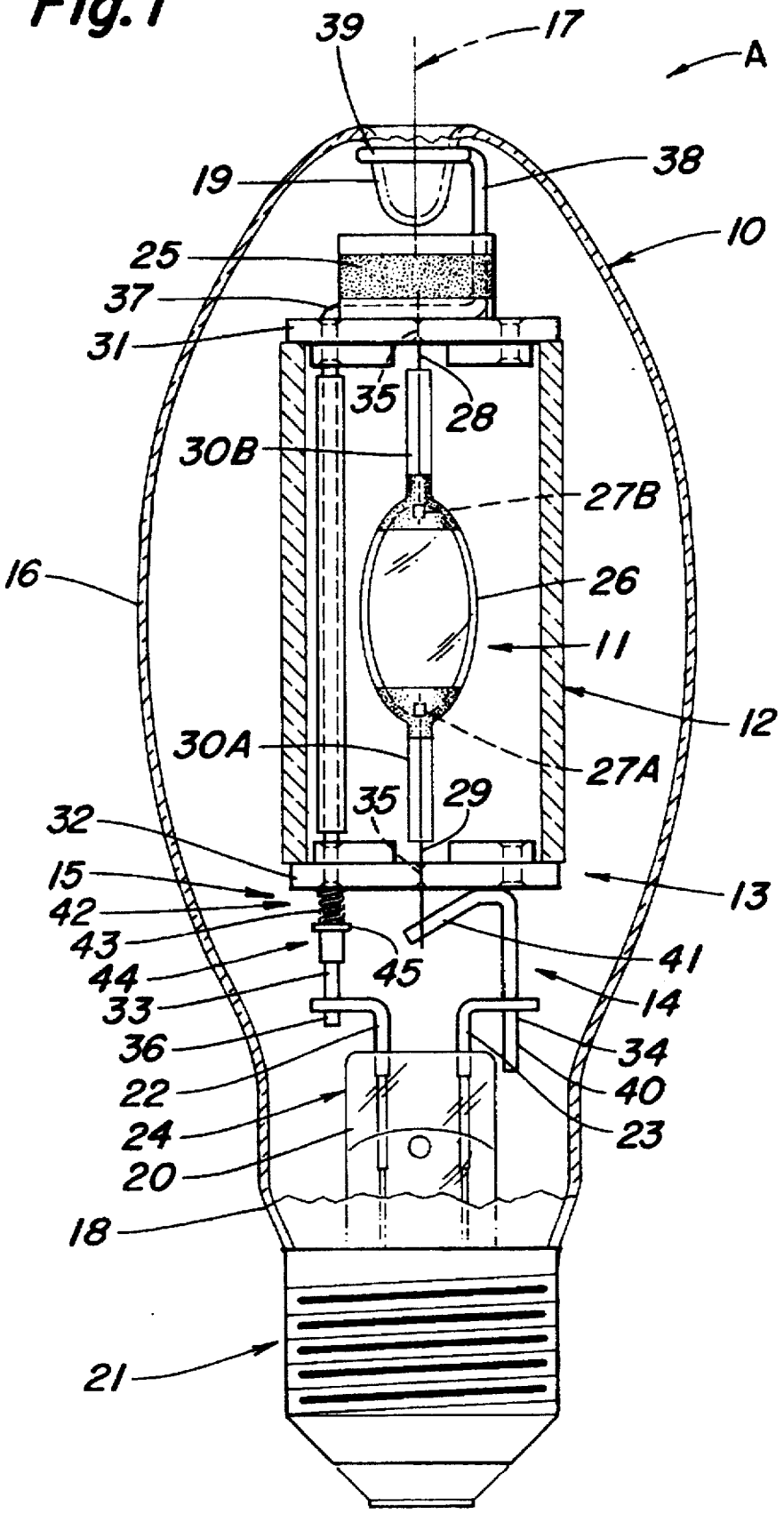
FIG. 1 is a partial sectional view of a preferred high pressure discharge lamp capable of maintaining outer jacket integrity in the event of a ruptured arc tube in accordance with the subject invention; and, FIG. 2 is an enlarged partial sectional view of the lamp of FIG. 1 with the envelope removed.
Figure 2:
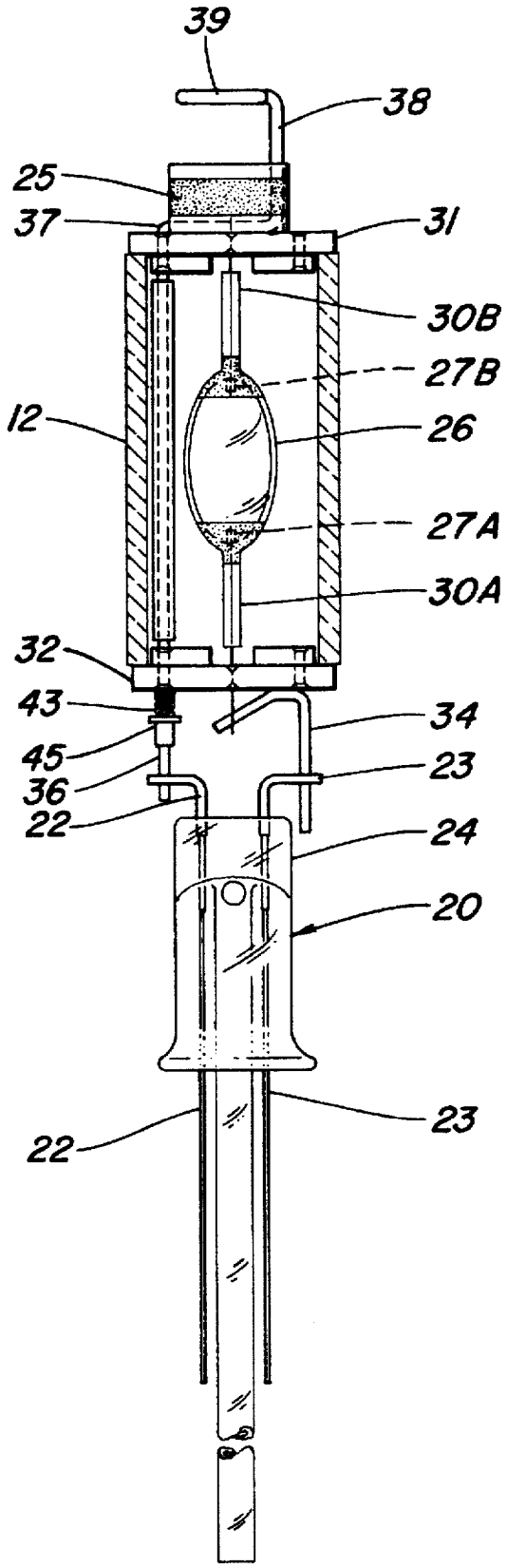

Referring now to the drawings wherein the showings are for the purposes of illustrating the preferred embodiments of the invention only and not for purposes of limiting same, An electric lamp assembly A in accordance with a preferred embodiment of the invention is shown in FIGS. 1 and 2. The lamp assembly A may be of any type of lamp known in the art where at least part of the assembly is under a pressure different than atmospheric pressure. One such type is the high pressure discharge lamp.

The lamp assembly A shown in FIGS. 1 and 2, and as described below as one example of a lamp having the inventive features of this application is a high pressure discharge lamp of a metal halide arc discharge lamp variety. The lamp assembly A having the below described novel features could be used in applications other than a high pressure discharge lamp of a metal halide arc discharge lamp variety as described herein such as for instance an incandescent variety.

This metal halide arc discharge lamp as shown as one embodiment of lamp assembly A includes a bulb or outer envelope 10, a light source such as a lamp capsule or arc tube 11, a glass tube or shroud mechanical support means 13, electrical coupling means 14, and vibration absorbing and close contact maintaining means 15.

The outer envelope 10 has a main or dome region or portion 16 elongated along a central axis 17. The outer envelope 10 also includes a neck region or portion 18. Alternatively, the dome portion can also be a cylindrical or tubular extension of the neck portion terminating in a rounded top. The dome portion 16 has a dimple 19 along the central axis 17 at the upper end of the outer envelope 10 (as viewed). The neck portion 18 has an inside diameter generally perpendicular to the central axis 17. The outer envelope 10 is typically formed of a blow molded hard glass such as borosilicate.

The outer envelope 10 is hermetically sealed with a glass stem 20 which extends into the neck portion 18 along the central axis 17. A base 21, formed for easy connection to an electrical source, is fixed to the outer envelope 10. A pair of electrical conductors or stem leads 22 and 23 pass through the stem 20 and are sealed by a stem press 24 as is known in the art. The stem leads 22, 23 are electrically connected to the base 21 external of the outer envelope 10 to provide access for energization of the lamp.

Additionally, a zirconium aluminum or barium peroxide getter 25 is positioned within and at the upper end of the outer envelope 10 (as viewed) generally adjacent the dimple 19. As is well known, getters are important in any structure where a low contaminant environment is desired.

As best seen in FIG. 1, the arc tube 11 is disposed within the outer envelope 10 substantially parallel to the outer envelope central axis 17 and substantially within an interior space or cavity of the shroud 12. The arc tube 11 includes a bulb portion 26, two electrodes 227A and 27B, a first or upper electrical or electrode lead 28, a second or lower electrical or electrode lead 29, and two pinch or press seals 30A and 30B. It will be noted that in other types of lamp assemblies the arc tube is of a different configuration, for example instead of two electrodes there may be a filament. The bulb portion 26 encloses a sealed discharge region which contains a suitable fill material for maintaining an arc discharge and is disposed within the interior cavity of the shroud 12.

Preferably, the arc tube 11 is of an ellipsoidal design such as disclosed in U.S. Pat. No. 4,161,672 the disclosure of which is expressly incorporated by reference herein in its entirety. Electrodes 27A and 27B are positioned at opposite ends of the discharge region. The press seals 30A and 30B are located at opposite first and second electrical or electrode ends of the bulb portion 26 and seal electrical or electrode leads 28 and 29 to provide sealed electrical feedthroughs to the electrodes 27A and 27B. It will be noted that the arc tube 11 of the preferred embodiment is a metal halide arc discharge lamp but can be a tungsten halogen incandescent lamp or other lamp which is advantageously operated with a shroud.

The shroud 12 is preferably a cylindrically-shaped tube having two ends which are open to an interior space, cavity or zone. Preferably, the shroud 12 is made of a light-transmissive and heat-resistant material such as quartz or glass. The shroud 12 is within the outer envelope 10 generally coaxial with the arc tube 11.

Means for supporting 13 the arc tube 11 and shroud 12 includes upper and lower insulator support stops or stops 31 and 32, a first conductor wire 33, and a "j-frame" or second conductor wire 34. The support means 13 is preferably within the outer diameter of the shroud 12, that is, it does not laterally extend beyond an infinite column defined by the outer diameter of the shroud 12.

Stops 31 and 32 are generally rectangularly shaped and have a notch or step at each end from which forms an axially facing surface and a laterally facing surface such as disclosed in U.S. Pat. No. 5,493,167 the disclosure of which is expressly incorporate by reference herein in its entirety. The length, width, and other dimensions and geometry as disclosed in the '167 reference are specifically incorporated by reference. However, it will be noted that other stop geometries are possible such as, for example but not limited to, the stops could be generally circularly shaped, the stops could have an angled surface replacing the laterally facing and/or axially facing surfaces, or the stops could engage only the ends of the shroud.

Substantially at the center of each stop 31 and 32 is an opening or centering hole 35 as also described in detail in U.S. Pat. No. 5,493,167 which extends axially through the stop and sized for passage of the electrode leads 28 and 29 of the arc tube 11. The geometry and configuration including the clearance slot are specifically incorporated by reference, although other geometries and configurations are possible and contemplated.

The first conductor wire 33 has a first axial portion 36 generally parallel to the outer envelope central axis 17 that extends from one of the stem lead 22 through one of the holes 35 in the lower stop 32, the shroud 12, and one of the holes 35 in the upper stop 31. Upon exiting the upper stop 31, the first conductor wire 33 has a first lateral portion 37 extending past the upper electrode lead 28 and generally adjacent an outer surface of the upper stop 31, preferably configured to limit axial movement of upper stop 31. Preferably the first lateral portion 37 is bent away from the upper support stop 31 near the upper electrode lead 28. At the end of the first lateral portion 37 opposite the first axial portion 36 is a second axial portion 38. The second axial portion 38 extends to the upper end of the outer envelope 10 where a second lateral portion 39 generally encircles the dimple 19 of the outer envelope 10 to limit movement of the arc tube 11 and shroud 12 within the outer envelope 10 and improve rigidity of the entire assembly.

The second conductor wire 34 has an axial portion 40 generally parallel to the outer envelope central axis 17 that extends from the other stem lead 23 to the outer surface of the lower stop 32. At the lower stop 32 the second conductor wire 34 has a lateral portion 41 extending past the lower electrode lead 29 and having at least a portion against an outer surface of the lower stop 32 adjacent the lower electrode lead 29. Forming the first and second conductor wires 33 and 34 as described above enable the conductor wires 33 and 34 to engage the outer surfaces of the stops 31 and 32 to retain the shroud 12 therebetween.

The means for electrically coupling 14 the stem leads 22 and 23 to the electrode leads 28 and 29 includes the first and second conductor wires 33 and 34. Preferably, at least a portion of the mechanical support means 13 electrically couples the stem leads 22 and 23 to the electrode leads 28 and 29. In the preferred embodiment, the first and second conductor wires 33 and 34 act as both mechanical support means 13 and electrical coupling means 14. With this embodiment the number of parts and the number of welds is minimized.

The first conductor wire 33 extends through the interior zone of the shroud 12 adjacent the arc tube 11 from one of the shroud ends to the other of the shroud ends. It should be noted that the first conductor wire 33 extends through a critical area in close proximity to the arc tube 11, or within the interior zone of the shroud from an area adjacent the first electrical lead end to an area adjacent the second electrical lead end. Thus, the first conductor wire 33 passes between the outer diameter of the arc tube bulb portion 26 and the inner diameter of the shroud 12 generally adjacent the arc tube bulb portion 26 or the arc tube discharge zone. The first conductor wire 33 extends within the interior zone of the shroud 12 and is operative to couple one of the stem leads to the electrode lead 28.

Preferably, at least a central portion of the first conductor wire 33 passing through the shroud's interior zone generally adjacent or in close proximity to the bulb portion 26 is surrounded by means for electrically insulating the first conductor wire 33. The result is an electric lamp with improved strength that is more robust to shock, easier to assemble, and that removes audible noise or rattles from the mount.

In a preferred embodiment, a compression spring assembly 42 positioned on first conductor wire 33 supplants the arc tube as the tension bearing member, i.e., removes the tension from the arc tube by displacing it to the compression spring and first conductor wire.

The compression spring assembly 42 as is shown in FIGS. 1 and 2, includes a compression spring 43 and stop means 44. The spring 43 pins the inelastic surrounding parts together, the shroud 12, and the upper and lower insulator support stops 31 and 32 together. Specifically, the support stops 31 and 32 are compressed against the shroud 12 resulting in the compression spring assembly 42 acting to maintain close contact between these inelastic parts thereby avoiding loose contact between these parts. The result is the avoiding of slippage, poor connections, and early lamp failure. Also, by placing the tension on the first conductor wire 33 rather than the arc tube 11, tension is removed from the delicate and sensitive arc tube seal region which is hermetically sealed.

The compression spring 43 slips over the first conductor wire 33 which extends through both insulator support stops 31 and 32, and shroud 12. Stop means 44 is slipped over the first conductor wire 33 such that the stop means 44 push against the compression spring 43. The spring 43 is forced against lower insulator support stop 32. The force is such that the stop means 44 pushes the spring 43 a set distance whereby the spring 44 is compressed to the desired tension at which point the stop means 44 is secured. In the most preferred embodiment, the stop means 44 is a brass eyelet 45 that is secured to the first conductor wire 33 by a resistive weld.

In the embodiment shown in FIG. 1, the first conductor wire 33 functions as the tension member rather than the arc tube as in the prior art. The upper and lower insulator support stops 31 and 32 and the shroud 12 function as the compression members. Since the compression spring assembly 42 acts to maintain close contact between these inelastic members, loose contact is avoided thereby avoiding slippage, poor connections, and early lamp failure. Also, by placing the tension on the first conductor wire 33 rather than the arc tube 11, tension is removed from the delicate and sensitive arc tube seal region which is hermetically sealed.

The invention has been described with reference to the preferred embodiments. Obviously, modifications and alterations will occur to others upon a reading and understanding of this specification. It is intended to include all such modifications and alterations insofar as they come within the scope of the appended claims or the equivalents thereof.

What we claim as new and desire to secure by Letters Patent of the United States is:

1. An electric lamp assembly comprising:

an outer envelope having a central axis, and wherein the envelope includes a dome portion and a neck portion;

glass stem hermetically sealing the envelope and having first and second stem leads therein;

a base capable of connection to an electrical source and affixed to the neck region of the outer envelope;

a shroud having an interior chamber;

upper and lower insulator support stops;

a light source located within the interior chamber of the shroud and supported by the support stops, the light source having electrode leads therein;

first and second conductor wires for electrically coupling the stem leads to the electrode leads, and supplying additional mechanical support; and, a separate compression spring secured about the first conductor wire and a stop member secured thereto for removing tension loading from the light source.

2. The electric lamp assembly of claim 1 wherein the tension shifting means comprises vibration absorbing and close contact maintaining means.

3. The electric lamp assembly of claim 1 wherein the said stop member comprises an eyelet for securing the compression spring to the first conductor wire at a preselected distance from the lower insulator support stop.

4. The electric lamp assembly of claim 1 wherein the light source is an arc tube.

5. An electric lamp assembly comprising: a sealed light-transmissive lamp envelope having a base capable of connection to an electrical source; a light transmissive shroud disposed within said envelope and having an interior zone;

a light source for generating light when electrical energy is applied thereto and having a pair of electrical leads and a light-transmissive bulb portion, said bulb portion located within said interior zone of said shroud;

means for mechanically supporting said light source and said shroud within said envelope;

means for electrically coupling said light source electrical leads to said base; and, means for absorbing vibrations within the lamp and for maintaining close contact between the light source and the light-transmissive shroud where the absorbing and maintaining means comprises a compression spring and further comprises stop means.

6. The lamp according to claim 5, wherein said compression spring is operatively coupled to said support means.

7. The lamp according to claim 5, wherein said compression spring is also operatively coupled to said coupling means.

8. The lamp according to claim 5, wherein said stop means operatively secures the spring at a desired tension.

9. The lamp according to claim 5, wherein said stop means is an eyelet.

10. The lamp according to claim 5, wherein said sealed light-transmissive lamp envelope includes a dome region and a neck region sealed to a lamp stem adjacent said base, said lamp stem defining a portion of said means for electrically coupling said light source electrical leads to said base therein whereby a pair of stem leads sealed in said lamp stem pass therethrough.

11. The lamp according to claim 5, wherein the light source is an arc tube.

12. An electric lamp assembly comprising:

a sealed light-transmissive lamp envelope having a base capable of connection to an electrical source;

a light transmissive shroud disposed within said envelope, having an interior zone and having two open ends with at least a portion of said coupling means longitudinally extending within said interior zone of said shroud from one of said shroud ends to the other of said shroud ends;

a light source for generating light when electrical energy is applied thereto and having a pair of electrical leads and a light-transmissive bulb portion, said bulb portion located within said interior zone of said shroud;

means for mechanically supporting said light source and said shroud within said envelope;

means for electrically coupling said light source electrical leads to said base; and, means for absorbing vibrations within the lamp and for maintaining close contact between the light source and the light-transmissive shroud where the absorbing and maintaining means comprises a compression spring and further comprises stop means.

13. The lamp according to claim 12, wherein at least a portion of said coupling means mechanically supports said shroud.

14. The lamp according to claim 13, wherein said first electrode lead is at an end of said light source opposite said lamp stem and said second electrode lead is at an end of said light source adjacent said lamp stem, and said coupling means includes a first conductor wire extending through said interior zone from a first open end of said shroud to a second open end of said shroud and operative to couple one of said stem leads to said first electrode lead.

* * * * *